US007737676B2

(12) United States Patent
Kimura

(10) Patent No.: US 7,737,676 B2
(45) Date of Patent: Jun. 15, 2010

(54) SERIES REGULATOR CIRCUIT

(75) Inventor: Hiroyuki Kimura, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 99 days.

(21) Appl. No.: 12/252,363

(22) Filed: Oct. 16, 2008

(65) Prior Publication Data

US 2010/0097047 A1 Apr. 22, 2010

(51) Int. Cl.
*G05F 3/16* (2006.01)

(52) U.S. Cl. ..... 323/315

(58) Field of Classification Search ..... 323/315, 323/314, 317, 313, 312
See application file for complete search history.

(56) References Cited

U.S. PATENT DOCUMENTS

| | | | | |
|---|---|---|---|---|
| 5,675,240 | A | 10/1997 | Fujisawa et al. | |
| 6,005,378 | A | 12/1999 | D'Angelo et al. | |
| 6,160,490 | A | 12/2000 | Pace et al. | |
| 6,340,878 | B1 | 1/2002 | Oglesbee et al. | |
| 6,541,946 | B1 | 4/2003 | Chen et al. | |
| 6,614,295 | B2 * | 9/2003 | Tsuchi | 327/563 |
| 6,690,147 | B2 | 2/2004 | Bonto | |
| 6,861,827 | B1 | 3/2005 | Yang et al. | |
| 6,952,091 | B2 | 10/2005 | Bansal | |
| 6,960,907 | B2 | 11/2005 | Poss | |
| 6,965,223 | B1 | 11/2005 | MacLean et al. | |
| 6,989,659 | B2 | 1/2006 | Menegoli et al. | |
| 7,091,710 | B2 | 8/2006 | Yang et al. | |
| 7,129,686 | B1 | 10/2006 | Huang | |
| 7,176,668 | B2 | 2/2007 | Oswald et al. | |
| 7,221,132 | B2 | 5/2007 | Okubo et al. | |
| 7,224,156 | B2 | 5/2007 | Chen | |
| 7,245,115 | B2 | 7/2007 | Chilcote | |
| 7,405,546 | B2 | 7/2008 | Amrani et al. | |
| 7,420,356 | B2 | 9/2008 | Hojo | |
| 2007/0018621 | A1 | 1/2007 | Mok et al. | |
| 2007/0182399 | A1 | 8/2007 | Enjalbert | |
| 2008/0191671 | A1 | 8/2008 | Shikata | |
| 2008/0191673 | A1 | 8/2008 | Kimura | |

FOREIGN PATENT DOCUMENTS

| | | | |
|---|---|---|---|
| JP | 2003177829 | A | 6/2003 |
| JP | 2005011280 | A | 1/2005 |
| JP | 2007004581 | A | 1/2007 |

* cited by examiner

*Primary Examiner*—Shawn Riley
(74) *Attorney, Agent, or Firm*—Charles Bergere

(57) ABSTRACT

A low drop out series regulator circuit for generating an output voltage that does not rely on voltage feedback or require a capacitor for stable operation includes first and second current sources connected in series between a supply voltage and ground. A resistor is connected between and in series with the first and second current sources, and a reference voltage is generated across the resistor by the current from the first current source. A first transistor is connected between the ground and a first node located between the resistor and the second current source. A current mirror circuit is connected between the supply voltage and the first transistor. A current sense transistor is connected between the current mirror circuit and an output terminal. An output transistor is connected between the supply voltage and the output terminal. The output voltage generated at the output terminal is equal to the reference voltage.

8 Claims, 2 Drawing Sheets

SERIES REGULATOR CIRCUIT

FIELD OF THE INVENTION

The present invention relates to relates to a series regulator circuit and more particularly to a series regulator circuit that does not require a large capacitor for providing a stable output voltage.

BACKGROUND OF THE INVENTION

Regulator circuits are used in semiconductor devices to provide a stable DC (Direct Current) output voltage with little fluctuation to a load. Such regulators are also known as Low Drop Out (LDO) regulators. Typically, LDO regulators rely on feedback voltage to maintain a constant output voltage. That is, an error signal whose value is a function of the difference between the actual output voltage and a nominal value is amplified and used to control current flow through a pass device such as a power transistor, from the power supply to the load. The drop-out voltage is the value of the difference between the power supply voltage and the desired regulated voltage. Most LDO regulators also include a bypass capacitor coupled to the load to ensure a stable output voltage.

The low drop out nature of the regulator makes it useful in portable devices such as cameras, which have a battery power supply. Oftentimes the bypass capacitor must have a large capacitance to ensure stable operation. However, the use of such a large capacitor is costly and impacts integration of the regulator circuit on a chip. Thus, there is a need for an on-chip, capacitor free regulator.

BRIEF DESCRIPTION OF THE DRAWINGS

The invention, together with objects and advantages thereof, may best be understood by reference to the following description of the presently preferred embodiment together with the accompanying drawings in which.

DETAILED DESCRIPTION OF THE PREFERRED EMBODIMENT

Figure 1:
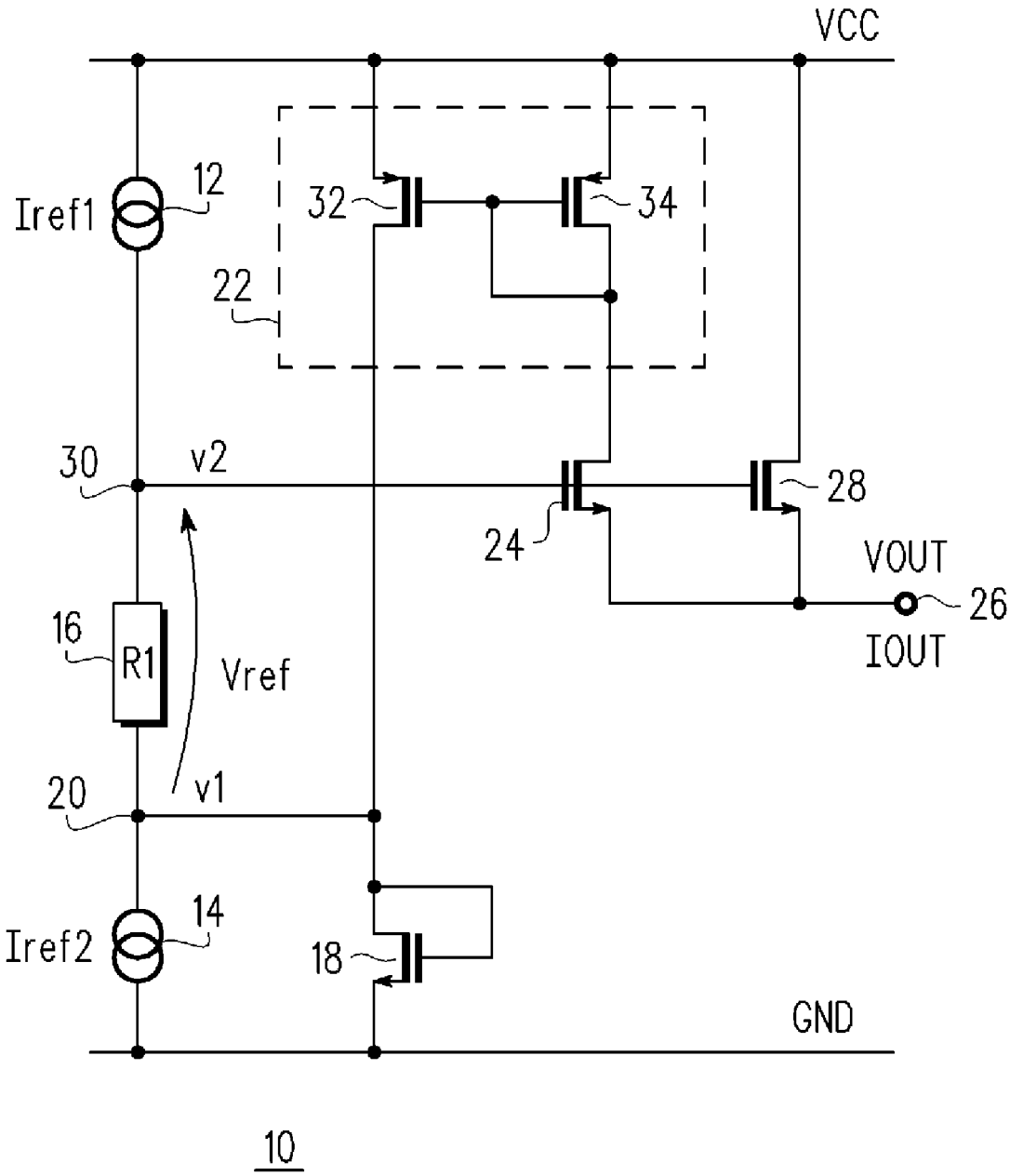
FIG. 1 is a schematic circuit diagram of a series regulator circuit according to an embodiment of the present invention.

The detailed description set forth below in connection with the appended drawings is intended as a description of a presently preferred embodiment of the invention, and is not intended to represent the only form in which the present invention may be practiced. It is to be understood that the same or equivalent functions may be accomplished by different embodiments that are intended to be encompassed within the spirit and scope of the invention. In the drawings, like numerals are used to indicate like elements throughout.

A series regulator circuit 10 in accordance with an embodiment of the present invention will now be discussed with reference to FIG. 1. The series regulator circuit 10 includes first and second current sources 12 and 14 (Iref1 and Iref2) connected in series between a supply voltage Vcc and ground. A resistor 16 is connected between and in series with the first and second current sources 12 and 14. A reference voltage Vref is generated across the resistor 16 by the current from the first current source 12.

A first transistor 18 is connected between the ground and a first node 20 located between the resistor 16 and the second current source 14. In the embodiment shown, the first transistor 18 is an NMOS transistor having a source connected to the ground, a drain connected to the first node 20 and a gate connected to its drain. A current mirror circuit 22 is connected between the supply voltage Vcc and the first transistor 18. A current sense transistor 24 is connected between the current mirror circuit 22 and an output terminal 26, which outputs an output voltage Vout.

An output transistor 28 is connected between the supply voltage Vcc and the output terminal 26. The output voltage Vout generated at the output terminal 26 is equal to the reference voltage Vref. In the embodiment shown, the current sense transistor 24 comprises a second NMOS transistor having a source connected to the output terminal, a drain connected to the current mirror circuit 22, and a gate connected to a second node 30 located between the first current source 12 and the resistor 16; and the output transistor 28 comprises a third NMOS transistor having a source connected to the output terminal 26, a drain connected to the supply voltage Vcc, and a gate connected to the gate of the current sense transistor 24.

The voltage across the resistor 16, Vref is a product of the first resistor and the current generated by the first current source 12 (Iref), so Vref is proportional to the first resistor 16 and to Iref1. The value of the first resistor 16 may be changed in order to set a desired value for the output voltage, VOUT. For example, in one embodiment of the invention, a supply voltage Vcc=9 v, Iref1=5 uA, and first resistor 16 of 500 kohms were used to generate an output voltage VOUT of 2.5V. Although a smaller supply voltage could have been used, one providing 9V was readily available.

To maintain Vref the same for the regulator 10, the current across the resistor 16 (Iref) has to be inversely proportional to the value of the first resistor 16. Iref1 can be formed with a resistor that is the same type as the first resistor 16 and a bandgap voltage generator. Iref can be copied to Iref1 or Iref2 by using current mirrors.

In one embodiment of the invention, the current sense transistor 24 and the output transistor 28 are the same type (N-type transistors) but the sizes are different so the current through the current sense transistor 24 is proportional to the current through the output transistor 28 and IOUT (at the output terminal 26).

The current mirror circuit 22 includes first and second PMOS transistors 32 and 34. More particularly, the first PMOS transistor 32 has a source connected to the supply voltage Vcc and a drain connected to the drain of the first transistor 18. The second PMOS transistor 34 has a source connected to the supply voltage Vcc, a drain connected the drain of the current sense transistor 24, and a gate connected to its drain and the gate of the first PMOS transistor 32. The current through the first PMOS transistor 32 is proportional to the current through the second PMOS transistor 34, the current sense transistor 24 and IOUT at the output terminal 28. Thus, PMOS transistors 32 and 34, as well as the current sense transistor 24 operate as a current mirror of IOUT.

The current through the first transistor 18, which is an N-type transistor, is equal to Iref1+I_P1−Iref2, where Iref1=Iref2, I_N1 is the same as I_P1. I_P1 is the current through the first PMOS transistor 32 and I_N1 is the current through the first transistor 18. Thus, current through the first transistor 18 is proportional to IOUT. If the size of the first transistor 18 is selected to be the same current density as the output transistor 28, both VGSs are the same (VGS_N1=VGS_N3), independent of IOUT. (VGS_N1 is the Gate-Source voltage of the first transistor 18 and VGS_N3 is the Gate-Source voltage of the third transistor 28.) Thus, the voltage equation can be written as VSG_N1+Vref−VGS_N3=VOUT, so VOUT=Vref.

For Vcc, max Vcc is defined by the breakdown of each device in the circuit 10. Min Vcc is dependent on VOUT and the head room between Vcc and VOUT. Between Vcc and VOUT, there are Iref1, the second PMOS transistor 34, the current sense transistor 24 and the output transistor 28. If the drop down voltage, Vcc−VOUT is low, VDS mismatch will be large between the current sense transistor 24 and the output transistor 28, which will cause a current mismatch between the current through the current sense transistor 24 and the output transistor 28 because of VGS of the second PMOS transistor 34. The current mirror 22 of the first and second PMOS transistors 32 and 34 can be replaced by a low voltage type. In this case, current mismatch between the current through the current sense transistor 24 and the output transistor 28 remains low.

At high IOUT operation, VGS of the current sense transistor 24 and the output transistor 28 is large, so head room of Iref1 is important. If current sense transistor 24 is realized with PMOS, the voltage across Iref1 should be at least a couple of hundred mV. If low Vth devices are used as the first transistor 18, the current sense transistor 24 and the output transistor 28, then for low voltage drop between Vcc and VOUT, head room of Iref2 will be a limitation.

Figure 2A:
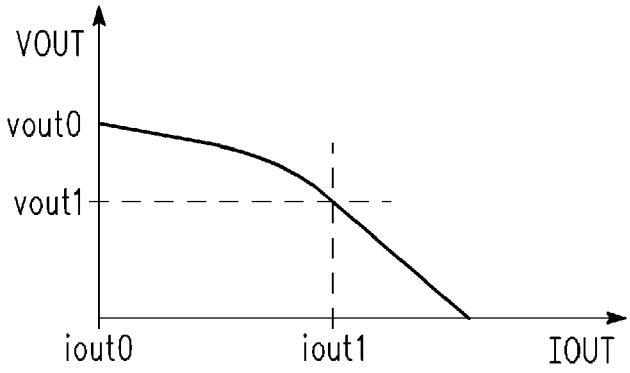
FIG. 2A is a graph showing the relationship of VOUT (voltage) versus IOUT (current) for the circuit of FIG. 1.
Figure 2B:
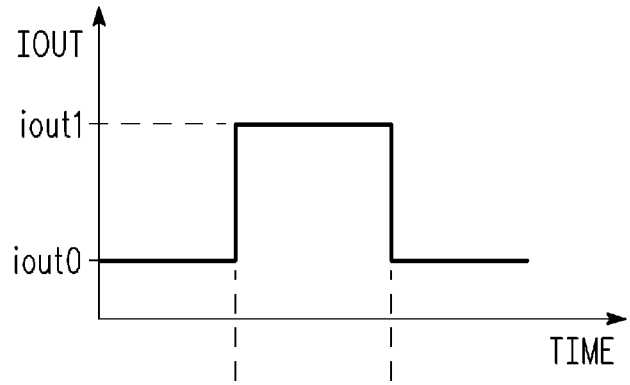
FIG. 2B is a graph illustrating a step change in the output current from IOUT0 to IOUT1 and vice-versa for the circuit of FIG. 1.
Figure 2C:
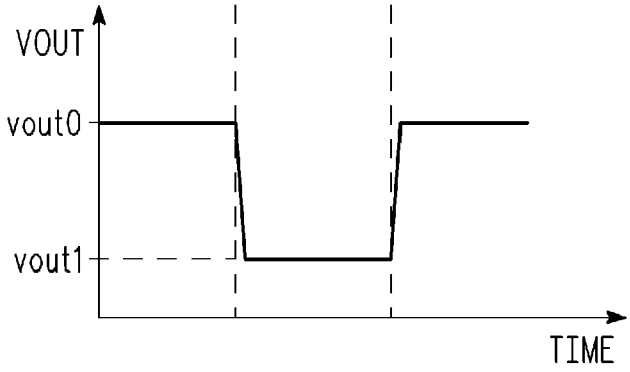
FIG. 2C is a graph showing a step response in the output voltage due to the step output current change shown in FIG. 2B, for the circuit of FIG. 1.

Referring now to FIGS. 2A, 2B and 2C, graphs are shown to illustrate the operation of the circuit 10. FIG. 2A is a characteristic example of VOUT vs. IOUT. In an actual application, voltage compensation at VGS_N1 may be imperfect due to nonlinearity or mismatch. FIG. 2B shows a step change in the output current from iout0 to iout1 and vice-versa. FIG. 2C shows a step response due to the step output current change shown in FIG. 2B. There is no overshoot because the circuit 10 does not include a voltage feedback loop.

It should be noted that an ordinary LDO has a drop out voltage of a few hundred mV, but the circuit 10, as described above, requires about 1V so the drop out voltage may be too large for an LDO. However, if Iref1 12 has a voltage generator that has a voltage higher than Vcc and a low voltage current mirror circuit is used, then the circuit 10 may be considered as an LDO. Further, if Iref1 12 has a voltage generator that is higher than Vcc, high Vth devices can be used as the transistors 18, 24 and 28 because V2 can go higher than Vcc and VOUT can be smaller than Vth.

As is evident from the foregoing discussion, the present invention provides low drop out series regulator that does not rely on voltage feedback to generate a stable output voltage. The series regulator of the present invention also does not require a large capacitor in order to provide a stable output voltage. Thus, the series regulator circuit of the present invention is ideal for integrated circuit applications for small, portable devices powered with a battery. The description of the preferred embodiment of the present invention has been presented for purposes of illustration and description, but is not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiment disclosed, but covers modifications within the spirit and scope of the present invention as defined by the appended claims.

The invention claimed is:

1. A series regulator for generating an output voltage, comprising:

first and second current sources connected in series between a supply voltage and ground;

a resistor connected between and in series with the first and second current sources, wherein a reference voltage is generated across the resistor by the current from the first current source;

a first transistor connected between the ground and a first node located between the resistor and the second current source;

a current mirror circuit connected between the supply voltage and the first transistor;

a current sense transistor connected between the current mirror circuit and an output terminal; and an output transistor connected between the supply voltage and the output terminal, wherein an output voltage generated at the output terminal is equal to the reference voltage.

2. The series regulator of claim 1, wherein the first transistor comprises a first NMOS transistor having a source connected to the ground, a drain connected to the first node and a gate connected to the drain.

3. The series regulator of claim 2, wherein the current sense transistor comprises a second NMOS transistor having a source connected to the output terminal, a drain connected to the current mirror circuit, and a gate connected to a second node located between the first current source and the resistor.

4. The series regulator of claim 3, wherein the output transistor comprises a third NMOS transistor having a source connected to the output terminal, a drain connected to the supply voltage, and a gate connected to the gate of the current sense transistor.

5. The series regulator of claim 4, wherein the current mirror circuit comprises:

a first PMOS transistor having a source connected to the supply voltage and a drain connected to the drain of the first transistor; and a second PMOS transistor having a source connected to the supply voltage, a drain connected the drain of the current sense transistor, and a gate connected to its drain and the gate of the first PMOS transistor.

6. A series regulator for generating an output voltage, comprising:

first and second current sources connected in series between a supply voltage and ground;

a resistor connected between and in series with the first and second current sources, wherein a reference voltage is generated across the resistor by the current from the first current source;

a first NMOS transistor connected between the ground and a first node located between the resistor and the second current source;

a current mirror circuit connected between the supply voltage and the first NMOS transistor;

a second NMOS transistor connected between the current mirror circuit and an output terminal; and a third NMOS transistor connected between the supply voltage and the output terminal, wherein an output voltage generated at the output terminal is equal to the reference voltage.

7. The series regulator of claim 6, wherein the current mirror circuit comprises:

a first PMOS transistor having a source connected to the supply voltage and a drain connected to the drain of the first NMOS transistor; and a second PMOS transistor having a source connected to the supply voltage, a drain connected the drain of the second NMOS transistor, and a gate connected to its drain and the gate of the first PMOS transistor.

8. The series regulator of claim 6, wherein the second NMOS transistor has a source connected to the output terminal, a drain connected to the current mirror circuit, and a gate connected to a second node located between the first current source and the resistor, and the third NMOS transistor has a source connected to the output terminal, a drain connected to the supply voltage, and a gate connected to the gate of the second NMOS transistor.

* * * * *